US009307310B2

(12) United States Patent
Chang et al.

(10) Patent No.: US 9,307,310 B2
(45) Date of Patent: Apr. 5, 2016

(54) WEARABLE PORTABLE ELECTRONIC DEVICE

(71) Applicant: Acer Incorporated, New Taipei (TW)

(72) Inventors: Ya-Ju Chang, New Taipei (TW); Jia-Ren Chang, New Taipei (TW)

(73) Assignee: Acer Incorporated, New Taipei (TW)

( * ) Notice: Subject to any disclaimer, the term of this patent is extended or adjusted under 35 U.S.C. 154(b) by 100 days.

(21) Appl. No.: 14/218,995

(22) Filed: Mar. 19, 2014

(65) Prior Publication Data

US 2015/0125020 A1 May 7, 2015

(30) Foreign Application Priority Data

Nov. 5, 2013 (TW) ..... 102140179 A

(51) Int. Cl.
*H04R 1/02* (2006.01)
*H04R 1/28* (2006.01)

(52) U.S. Cl.
CPC ..... *H04R 1/028* (2013.01); *H04R 1/28* (2013.01); *H04R 2499/11* (2013.01)

(58) Field of Classification Search
CPC ..... H04R 1/02; H04R 2499/11; H04R 1/028; H04R 2420/07; H04R 1/025; H04R 1/023; H04R 1/021
USPC ..... 381/334
See application file for complete search history.

(56) References Cited

U.S. PATENT DOCUMENTS

| | | | | |
|---|---|---|---|---|
| 6,072,392 | A * | 6/2000 | Henderson | G08B 1/08 340/539.15 |
| 7,096,048 | B2 * | 8/2006 | Sanders | H04B 1/385 381/338 |
| 8,126,138 | B2 | 2/2012 | Dinh et al. | |
| 8,208,670 | B2 * | 6/2012 | Wright | H04R 1/028 381/334 |
| 8,306,252 | B2 | 11/2012 | Dinh et al. | |
| 8,395,555 | B2 | 3/2013 | Hobson et al. | |
| 8,994,827 | B2 * | 3/2015 | Mistry | H04N 5/2252 348/158 |
| 2011/0003665 | A1 * | 1/2011 | Burton | G04F 10/00 482/9 |
| 2012/0122519 | A1 * | 5/2012 | Jochheim | H04B 1/385 455/556.1 |

FOREIGN PATENT DOCUMENTS

| | | |
|---|---|---|
| CN | 2586303 | 11/2003 |
| CN | 1534963 | 10/2004 |
| TW | 1353164 | 11/2011 |
| TW | 201141319 | 11/2011 |
| WO | 0055978 | 9/2000 |

* cited by examiner

*Primary Examiner* — Mark Blouin
(74) *Attorney, Agent, or Firm* — Jianq Chyun IP Office

(57) ABSTRACT

A wearable portable electronic device including a body and a speaker is provided. The body includes a base and a sidewall surrounding the base, wherein the sidewall has at least one opening. The speaker is disposed in the body, wherein a sound wave produced by the speaker is transmitted outward through the opening. An orthogonal projection of the speaker on the base is separated from an orthogonal projection of the opening on the base.

9 Claims, 3 Drawing Sheets

WEARABLE PORTABLE ELECTRONIC DEVICE

CROSS-REFERENCE TO RELATED APPLICATION

This application claims the priority benefit of Taiwan application serial no. 102140179, filed on Nov. 5, 2013. The entirety of the above-mentioned patent application is hereby incorporated by reference herein and made a part of this specification.

BACKGROUND

1. Technical Field

The invention relates to an electronic device. Particularly, the invention relates to a wearable portable electronic device.

2. Related Art

Along with development of technology, today's society has entered an era of information explosion. Therefore, various technological products are continuously developed, in which electronic devices such as cell phones, smart phones or personal digital assistant (PDA) phones, tablet PCs, notebook computers, etc. have real-time information transceiving and updating functions, and such type of electronic products have become a mainstream in the market.

Taking a smart phone as an example, a user generally puts the smart phone in a handbag or in a pocket, and takes it out and holds it by hand during usage. However, during a motion process of the user, the smart phone is probably dropped to cause damage or malfunction. On the other hand, along with popularity of sports culture, the user generally puts the smart phone in a sports arm bag or a waist bag. Although the former accommodating method can effectively protect the smart phone, it cannot satisfy a demand for synchronously reading information during the motion process of the user, so that the related manufacturers have actively involved in development of wearable portable smart electronic devices, for example, smart watches.

In detail, regarding the smart watch, a calling function is still taken as a main function of the smart watch, though along with reduction of a volume of the smart watch, various internal parts thereof are miniaturized, such that output sound quality is poor. Therefore, how to effectively improve calling quality and the output sound quality becomes a problem to be resolved.

SUMMARY

The invention is directed to a wearable portable electronic device, which is capable of effectively improving output sound quality by using a characteristic of a human ear auditory curve.

The invention provides a wearable portable electronic device including a body and a speaker. The body includes a base and a sidewall surrounding the base, wherein the sidewall has at least one opening. The speaker is disposed in the body, wherein a sound wave produced by the speaker is transmitted outward through the opening. An orthogonal projection of the speaker on the base is separated from an orthogonal projection of the opening on the base.

According to the above descriptions, by using the characteristic of the human ear auditory curve, the opening of the wearable portable electronic device is disposed at the sidewall of the body, where the opening is connected to a sound output chamber, and the orthogonal projection of the speaker on the base of the speaker is separated from the orthogonal projection of the opening on the base, so as to decrease a total harmonic distortion (THD) value to improve the output sound quality of the wearable portable electronic device.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
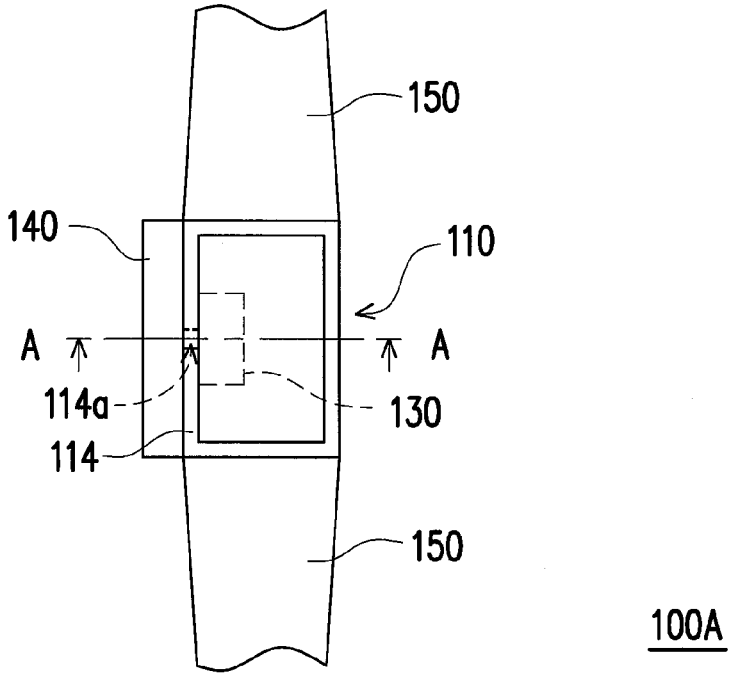
FIG. 1 is a schematic diagram of a wearable portable electronic device according to an embodiment of the invention.
Figure 2:
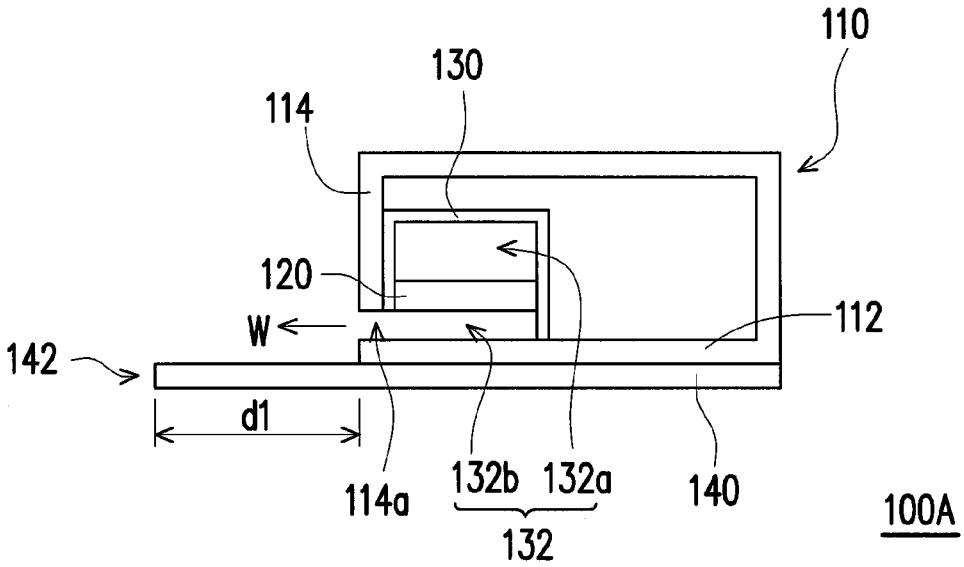
FIG. 2 is a cross-sectional view of the wearable portable electronic device of FIG. 1 along a section line A-A.

FIG. 1 is a schematic diagram of a wearable portable electronic device according to an embodiment of the invention. FIG. 2 is a cross-sectional view of the wearable portable electronic device of FIG. 1 along a section line A-A. Referring to FIG. 1 and FIG. 2, in the present embodiment, the wearable portable electronic device 100A is, for example, a smart watch, which is adapted to be worn on a user's wrist. The wearable portable electronic device 100A includes a body 110 and a speaker 120.

In the present embodiment, the body 110 is, for example, a metal casing, a plastic casing, a carbon fiber casing or a casing made of other materials. The body 110 includes a base 112 and a sidewall 114 surrounding the base 112. The sidewall 114 has at least one opening 114*a*. The speaker 120 is disposed in the body 110. A sound wave W produced by the speaker 120 is transmitted outward through the opening 114*a*. An orthogonal projection of the speaker 120 on the base 112 is separated from an orthogonal projection of the opening 114*a* on the base 112. In other words, the sound wave W produced by the speaker 120 is not directly transmitted outwards from a front side of the speaker 120 (for example, a side of the speaker having a vibration film), but is transmitted outward through the opening 114*a* located aside the speaker 120 after being reflected by the base 112. On the other hand, in an embodiment that is not illustrated, a host and a touch display screen of the wearable portable electronic device 100A are also disposed in the body 110 to provide a user interface integrated with multiple functions.

In the present embodiment, the wearable portable electronic device 100A further includes a frame 130. The frame 130 can be composed of metal, plastic or carbon fiber, etc. In detail, the frame 130 is disposed in the body 110 and has a chamber 132. The speaker 120 is disposed in the chamber 132 and divides the chamber 132 into a resonant chamber 132*a* and a sound output chamber 132*b*, where the sound output chamber 132*b* is connected to the opening 114*a* on the sidewall 114. In detail, a configuration method of the frame 130 and the speaker 120 is equivalent to a base reflex structure. Therefore, the sound wave W produced by the speaker 120 is first transmitted to the resonant chamber 132*a* for compensating and strengthening a low frequency part of the sound wave W through the resonant chamber 132, and then the sound wave W reflected by the resonant chamber 132*a* is transmitted to the sound output chamber 132*b* and is finally transmitted outward through the opening 114*a*. A ratio between a volume of the resonant chamber 132 and a volume of the sound output chamber 132*b* can be equal to 2, so as to improve a low frequency response of the speaker 120.

Referring to FIG. 1 and FIG. 2, in the present embodiment, the wearable portable electronic device 100A further includes a substrate 140 and a watchband 150. The substrate 140 is, for example, a metal substrate, a plastic substrate, a carbon fiber substrate or a substrate made of other materials, and a material of the watchband 150 connected to the substrate 140 includes leather, rubber, metal or other materials, such that the wearable portable electronic device 100A can be worn and fixed to the user's wrist as that does of a conventional watch. On the other hand, the body 110A can be combined to the substrate 140 through the base 112. Namely, the wearable portable electronic device 100A is, for example, a combined smart watch, and the user can assemble or disassemble the body 110 to/from the substrate 140 to cope with different usage states.

In detail, the substrate 140 has an extending region 142. The extending region 142 is not covered by the base 112 and is located besides the opening 114*a*. A distance d1 between one side of the extending region 142 away from the opening 114*a* and the opening 114*a* is smaller than 3 cm, or is between 4 cm and 9 cm. In this way, a total harmonic distortion (THD) value can be effectively decreased to improve output sound quality of the wearable portable electronic device 100A, where when the distance d1 approaches to about 3 cm, the output sound quality is the best.

Figure 3:
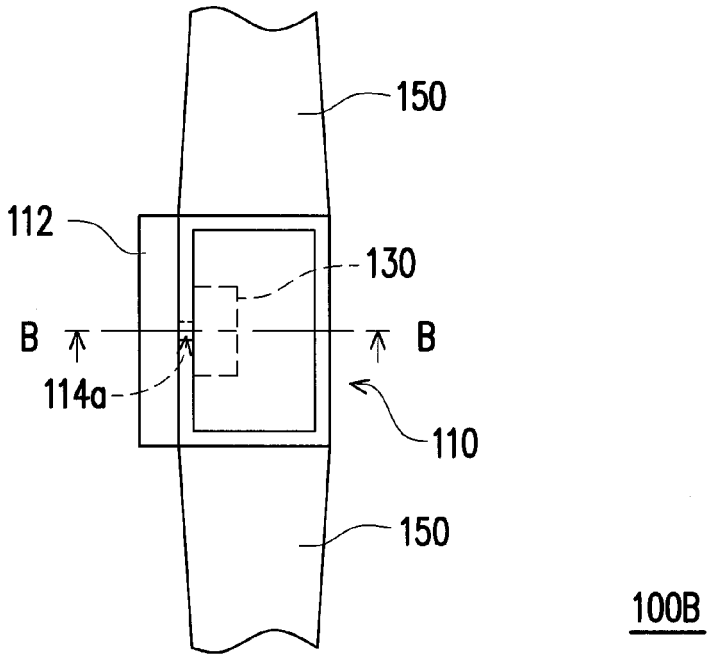
FIG. 3 is a schematic diagram of a wearable portable electronic device according to another embodiment of the invention.
Figure 4:
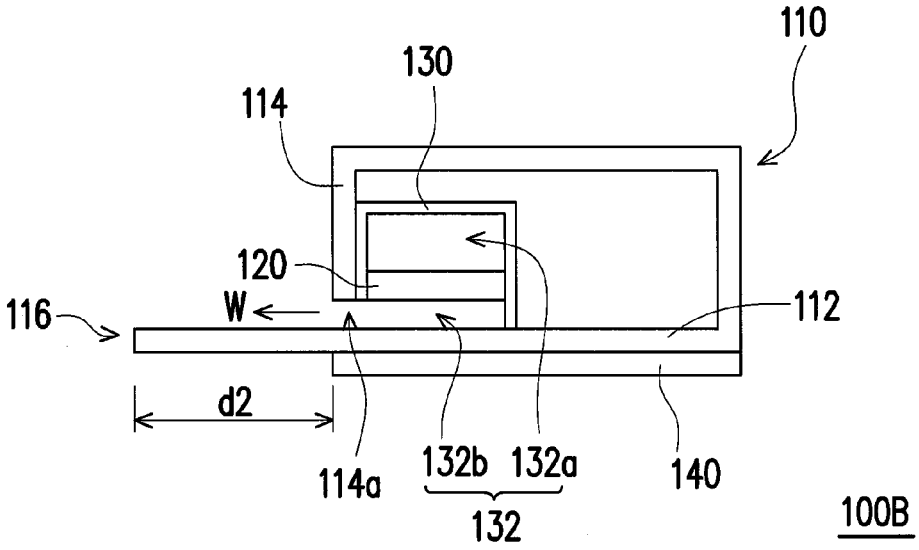
FIG. 4 is a cross-sectional view of the wearable portable electronic device of FIG. 3 along a section line B-B.

FIG. 3 is a schematic diagram of a wearable portable electronic device according to another embodiment of the invention. FIG. 4 is a cross-sectional view of the wearable portable electronic device of FIG. 3 along a section line B-B. Referring to FIG. 3 and FIG. 4, a difference between the wearable portable electronic device 100B of FIG. 3 and the wearable portable electronic device 100A of FIG. 1 is that in the present embodiment, the base 112 has an extending region 116, where the extending region 116 and the speaker 120 are separated by the sidewall 114. Namely, the extending region 116 of the base 112 and the speaker 120 are located at two opposite sides of the opening 114*a*, and a distance d2 between one side of the extending region 116 away from the opening 114*a* and the opening 114*a* is smaller than 3 cm, or is between 4 cm and 9 cm, where the distance d2 is preferably approached to about 3 cm. In this way, a technical effect similar to that of the aforementioned embodiment is achieved.

Figure 5:
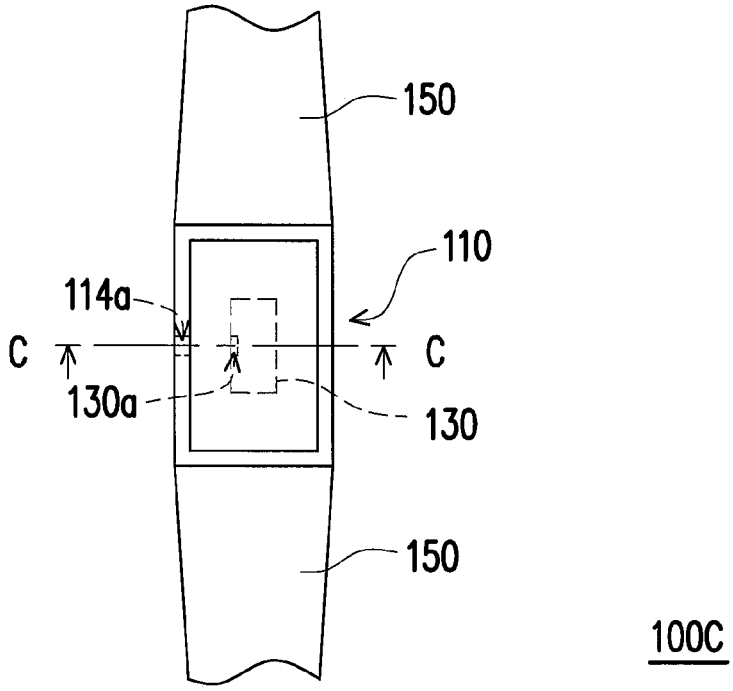
FIG. 5 is a schematic diagram of a wearable portable electronic device according to another embodiment of the invention.
Figure 6:
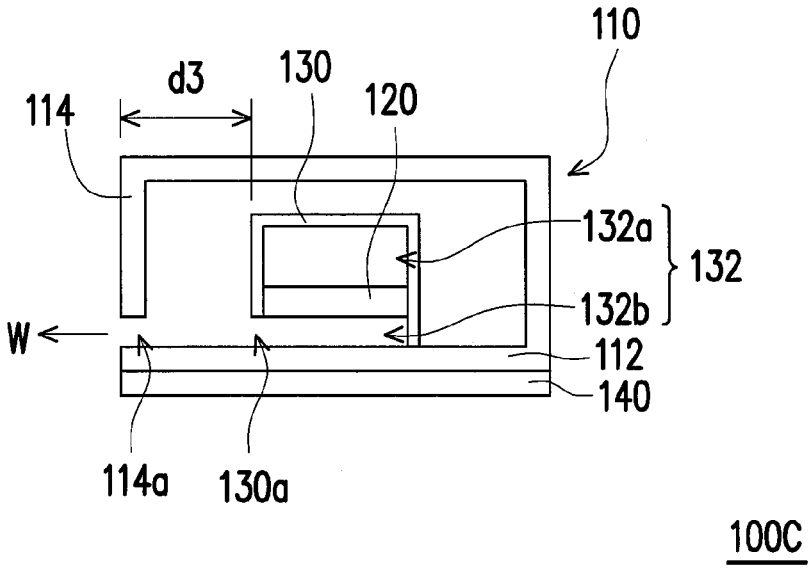
FIG. 6 is a cross-sectional view of the wearable portable electronic device of FIG. 5 along a section line C-C.

FIG. 5 is a schematic diagram of a wearable portable electronic device according to another embodiment of the invention. FIG. 6 is a cross-sectional view of the wearable portable electronic device of FIG. 5 along a section line C-C. Referring to FIG. 5 and FIG. 6, a difference between the wearable portable electronic device 100C and the wearable portable electronic devices of the aforementioned embodiments is that the frame 130 of the wearable portable electronic device 100C is disposed in the body 110 and does not lean against any sidewall 114. The frame 130 has at least one sound output opening 130*a*. The sound output opening 130*a* is connected to the chamber 132*b* and faces the opening 114*a*. In detail, a distance d3 is spaced between the sound output opening 130*a* and the opening 114*a*, and the distance d3 is smaller than 3 cm, or is between 4 cm and 9 cm, where the distance d3 is preferably approached to about 3 cm. In this way, a technical effect similar to that of the aforementioned embodiment is achieved.

In summary, by using the characteristic of the human ear auditory curve, the opening of the wearable portable electronic device is disposed at the sidewall of the body, where the opening is connected to a sound output chamber, and the orthogonal projection of the speaker on the base of the speaker is separated from the orthogonal projection of the opening on the base. On the other hand, the substrate or the base has an extending region besides the opening. A predetermined distance is spaced from one side of the extending region away from the opening and the opening. Under such configuration, the THD value is effectively decreased to improve the output sound quality of the wearable portable electronic device.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A wearable portable electronic device, comprising:

a body, having a base and a sidewall surrounding the base, wherein the sidewall has at least one opening;

a speaker, disposed in the body, wherein a sound wave produced by the speaker is transmitted outward through the opening, and an orthogonal projection of the speaker on the base is separated from an orthogonal projection of the opening on the base; and a frame, wherein the frame is disposed in the body and the frame has a chamber, the speaker is disposed in the chamber to divide the chamber into a resonant chamber and a sound output chamber, and the sound output chamber is connected to the opening on the sidewall.

2. The wearable portable electronic device as claimed in claim 1, wherein a ratio between a volume of the resonant chamber and a volume of the sound output chamber is equal to 2.

3. The wearable portable electronic device as claimed in claim 1, further comprising:

a substrate, combined to the body through the base; and a watchband, connected to the substrate, and fixed to a user's wrist.

4. The wearable portable electronic device as claimed in claim 3, wherein the substrate has an extending region, and the extending region is not covered by the base and is located besides the opening.

5. The wearable portable electronic device as claimed in claim 4, wherein a distance between one side of the extending region away from the opening and the opening is smaller than 3 cm.

6. The wearable portable electronic device as claimed in claim 4, wherein a distance between one side of the extending region away from the opening and the opening is between 4 cm and 9 cm.

7. The wearable portable electronic device as claimed in claim 1, wherein the base has an extending region, and the extending region and the speaker are separated by the sidewall.

8. The wearable portable electronic device as claimed in claim 7, wherein a distance between one side of the extending region away from the opening and the opening is smaller than 3 cm.

9. The wearable portable electronic device as claimed in claim 7, wherein a distance between one side of the extending region away from the opening and the opening is between 4 cm and 9 cm.

* * * * *